US009691564B2

(12) United States Patent
Krieger et al.

(10) Patent No.: US 9,691,564 B2
(45) Date of Patent: Jun. 27, 2017

(54) MOUNTING PLATE

(71) Applicant: SIEMENS AKTIENGESELLSCHAFT, Munich (DE)

(72) Inventors: Harald Krieger, Neuhaus (DE); Ekkehard Plechinger, Roeckersbuehl (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 521 days.

(21) Appl. No.: 14/207,760

(22) Filed: Mar. 13, 2014

(65) Prior Publication Data

US 2014/0284190 A1 Sep. 25, 2014

(30) Foreign Application Priority Data

Mar. 20, 2013 (DE) ..... 10 2013 204 936

(51) Int. Cl.

| | |
|---|---|
| ***H01H 9/26*** | (2006.01) |
| ***H01H 9/02*** | (2006.01) |
| ***H01H 71/02*** | (2006.01) |
| ***H01H 71/10*** | (2006.01) |

(52) U.S. Cl.

CPC ..... *H01H 9/02* (2013.01); *H01H 9/26* (2013.01); *H01H 71/0271* (2013.01); *H01H 71/1009* (2013.01)

(58) Field of Classification Search

CPC .. H01H 9/26; H01H 9/20; H01H 9/02; H01H 2009/265; H01H 71/0271; H01H 71/1009; H01H 71/0264; H01H 71/0285; F16M 13/02

USPC ..... 220/293, 50.01

See application file for complete search history.

(56) References Cited

U.S. PATENT DOCUMENTS

| | | | | |
|---|---|---|---|---|
| 4,595,896 | A * | 6/1986 | DiMarco | H01H 71/0257 174/125.1 |
| 4,616,200 | A * | 10/1986 | Fixemer | H01H 71/524 335/172 |
| 4,978,816 | A | 12/1990 | Morris | |
| 5,790,369 | A | 8/1998 | Sitler | |
| 7,355,132 | B1 * | 4/2008 | Rezac | H01H 9/223 200/43.14 |

FOREIGN PATENT DOCUMENTS

| | | |
|---|---|---|
| CN | 102651292 A | 8/2012 |
| DE | 4409172 A1 | 9/1994 |
| DE | 69217441 T2 | 7/1997 |

(Continued)

OTHER PUBLICATIONS

Chinese Office Action dated Aug. 25, 2015.
German Office Action for DE102013204936.6 dated Sep. 6, 2013.
German Priority Document 102013204936.6 dated Mar. 20, 2013.

*Primary Examiner* — Dimary Lopez Cruz
(74) *Attorney, Agent, or Firm* — Harness, Dickey & Pierce, P.L.C.

(57) ABSTRACT

A mounting plate is disclosed for supporting a circuit breaker accessory part. In an embodiment, the mounting plate includes a holding device, configured to hold the mounting plate on a wall of a housing of a circuit breaker and a fastening device, configured to fasten the circuit breaker accessory part to the mounting plate.

28 Claims, 4 Drawing Sheets

(56) References Cited

FOREIGN PATENT DOCUMENTS

| | | | |
|---|---|---|---|
| DE | 102009019577 | A1 | 11/2010 |
| EP | 0180537 | A2 | 5/1986 |
| EP | 0779641 | A1 | 6/1997 |
| EP | 0896348 | A2 | 2/1999 |
| EP | 1916682 | A1 | 4/2008 |
| EP | 2518748 | A1 | 10/2012 |

* cited by examiner

MOUNTING PLATE

PRIORITY STATEMENT

The present application hereby claims priority under 35 U.S.C. §119 to German patent application number DE 102013204936.6 filed Mar. 20, 2013, the entire contents of which are hereby incorporated herein by reference.

FIELD

At least one embodiment of the invention generally relates to a mounting plate for mounting a circuit breaker accessory part.

BACKGROUND

For circuit breakers, in particular for compact circuit breakers, there are various circuit breaker accessory parts. Such circuit breaker accessory parts are arranged externally to the circuit breaker and enhance the function of the circuit breaker. Examples of such circuit breaker accessory parts are a toggle lever interlock, a Bowden cable locking device, a toggle lever blocking apparatus, a manual rotary drive or a motor drive.

SUMMARY

At least one embodiment of the invention is directed to an apparatus, with which a circuit breaker accessory part can be fastened to the circuit breaker.

In one embodiment, a mounting plate is disclosed. Advantageous embodiments of the mounting plate are specified in the dependent claims.

A mounting plate is specified in accordance with at least one embodiment of the invention including a holding device configured to hold the mounting plate on a wall of a housing of a circuit breaker and a fastening device configured to fasten the circuit breaker accessory part to the mounting plate. In an embodiment, the mounting plate is held on the wall of the circuit breaker by way of the holding device and the circuit breaker accessory part is fastened to the mounting plate by way of the fastening device. This is advantageous in particular such that the fastening device for fastening the circuit breaker accessory part does not need to be arranged on the housing of the circuit breaker. As a result, space is saved on the housing of the circuit breaker, as a result of which the circuit breaker can be embodied in a particularly compact manner and with a small structural volume.

A circuit breaker having the mounting plate described above is also specified in accordance with an embodiment of the invention.

BRIEF DESCRIPTION OF THE DRAWINGS

Other aspects and features of embodiments of the present invention will become apparent from the following detailed descriptions considered in conjunction with the accompanying drawings. It is to be understood, however, that the drawings are designed solely for the purposes of illustration and not as a definition of the limits of the invention. They are not necessarily drawn to scale.

The invention is described in more detail below with the aid of an example embodiment. To this end

DETAILED DESCRIPTION OF THE EXAMPLE EMBODIMENTS

Figure 1:
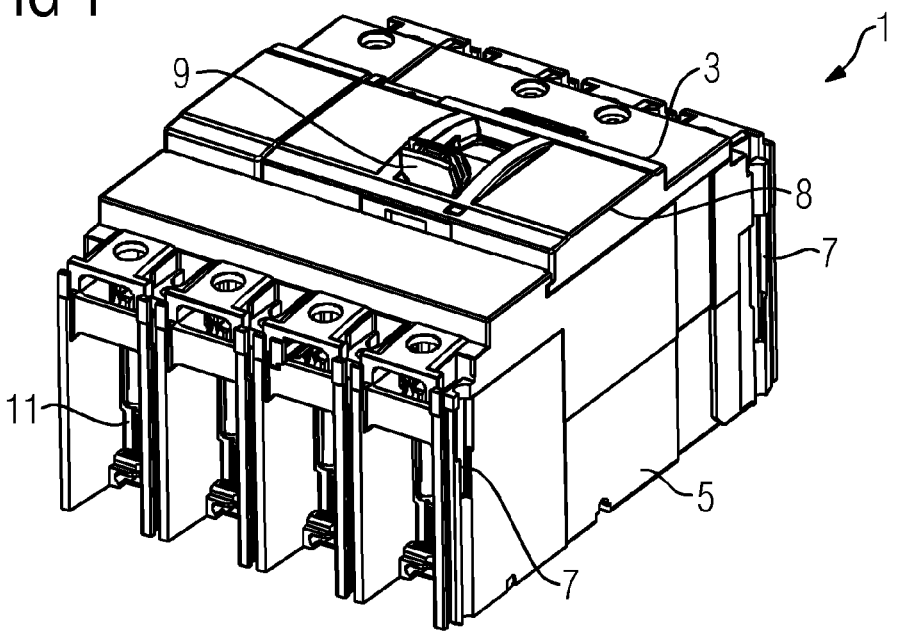
FIG. 1 shows an example embodiment of a circuit breaker.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A mounting plate is specified in accordance with at least one embodiment of the invention including a holding device configured to hold the mounting plate on a wall of a housing of a circuit breaker and a fastening device configured to fasten the circuit breaker accessory part to the mounting plate. In an embodiment, the mounting plate is held on the wall of the circuit breaker by way of the holding device and the circuit breaker accessory part is fastened to the mounting plate by way of the fastening device. This is advantageous in particular such that the fastening device for fastening the circuit breaker accessory part does not need to be arranged on the housing of the circuit breaker. As a result, space is saved on the housing of the circuit breaker, as a result of which the circuit breaker can be embodied in a particularly compact manner and with a small structural volume.

The holding device can be configured to embody a form-fit with the wall of the housing of the circuit breaker. The mounting plate can as a result be held on the wall of the housing of the circuit breaker without any play.

The mounting plate can be configured such that the holding device has a projection for engaging in a recess of the wall of the housing of the circuit breaker.

In such cases the projection can be a dovetail-shaped projection.

The mounting plate can be configured such that the fastening device has a contact surface for supporting the circuit breaker accessory part. This contact surface allows for a secure mounting of the circuit breaker accessory part.

In at least one embodiment, the mounting plate can also be configured such that the contact surface has at least one bore hole for fastening the circuit breaker accessory part to the contact surface (and thus to the mounting plate). This bore hole allows the circuit breaker accessory part to be securely fastened to the contact surface, for instance by means of a screw, a rivet, an engaging part or suchlike.

The mounting plate can be configured such that the at least one bore hole has an inner thread for screwing the circuit breaker accessory part to the fastening device. The circuit breaker accessory part can be securely and detachably connected to the fastening device by way of this inner thread and a matching screw.

The mounting plate can also be configured such that the mounting plate has reinforcing elements, in particular reinforcing ribs. As a result, a mounting plate is realized with high rigidity. The circuit breaker accessory part can be securely and reliably supported by the mounting plate.

The mounting plate can be configured such that the mounting plate has a break-through for screwing the mounting plate to the wall of the housing of the circuit breaker. This embodiment also allows the mounting plate to be screwed to the wall of the housing of the circuit breaker and as a result to hold the mounting plate particularly securely on the wall.

The mounting plate can also be configured such that the mounting plate is embodied in two parts, wherein a first part of the mounting plate has the holding device and wherein a second part of the mounting plate has the fastening device. The selection of the material of the first part and of the material of the second part allow for desired properties of the mounting plate to be achieved in a more cost-effective manner.

The mounting plate can be configured here such that the holding device and/or the first part consist of an insulation material, in particular of polyamide. The holding device and/or the first part can be particularly cost-effectively manufactured from such an insulation material, wherein complicated forms can also be realized (for instance by casting the insulation material). The dovetail-shaped projection can advantageously be manufactured from the insulation material for instance.

The mounting plate can also be configured such that the fastening device and/or the second part consist of metal, in particular steel. The required stability and rigidity of the mounting plate can be ensured in a simple and cost-effective manner by way of such a fastening device and/or second part consisting of metal.

The mounting plate can be structured such that the first part is fixedly connected to the second part, in particular riveted.

The mounting can also be configured such that the second part is a fitting, which is attached to the first part.

The mounting plate can be realized such that the second part has a plate-shaped region, which is fixedly connected to the first part, and the contact surface is arranged perpendicularly to the plate-shaped region.

The mounting plate can also be configured such that the contact surface is arranged perpendicularly to the plane of the mounting plate (plate plane).

A circuit breaker having the mounting plate described above is also specified in accordance with an embodiment of the invention.

The circuit breaker of an embodiment can be configured such that the circuit breaker is a compact circuit breaker with a housing made of insulation material.

An example embodiment of a circuit breaker 1 is shown in FIG. 1. In such cases it is a circuit breaker with a housing made of insulation material. Such a circuit breaker is also referred to as a compact circuit breaker or MCCB (Molded Case Circuit Breaker). A housing 3 of the circuit breaker has a wall in the form of a side wall 5, which likewise consists of insulation material. The side wall 5 has recesses 7, these recesses being used to form a form-fit between the wall 5 of the housing of the circuit breaker and a mounting plate. The housing 3 or the side wall 5 has an upper housing edge 8. In a known manner, the circuit breaker 1 also has a toggle 9, and space for electrical connections 11 (the electrical connections themselves are not shown in FIG. 1).

Figure 2:
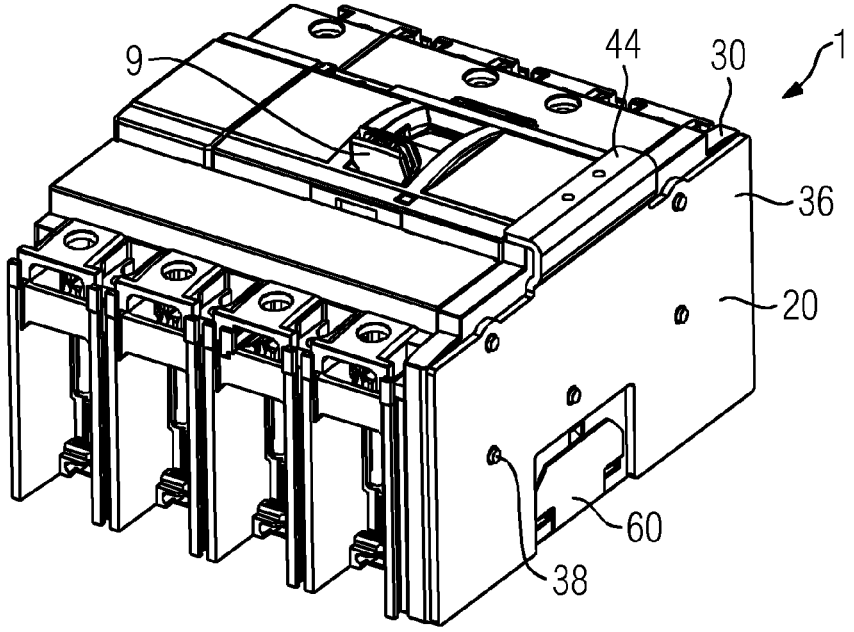
FIG. 2 shows the circuit breaker with a mounting plate mounted hereupon.

FIG. 2 shows a mounting plate 20 for supporting a circuit breaker accessory part, which is mounted on the circuit breaker 1.

Figure 3:
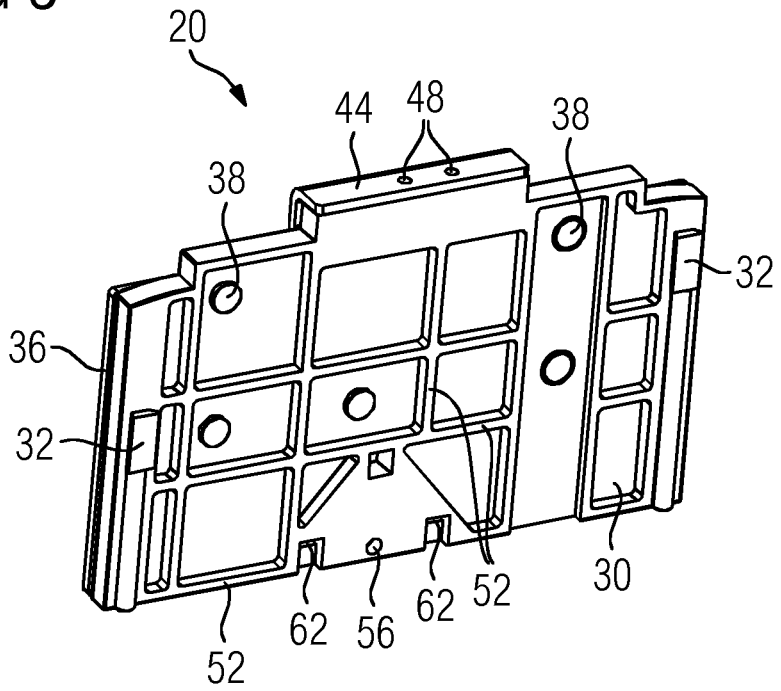
FIG. 3 shows the mounting plate in a view obliquely from the rear.
Figure 4:
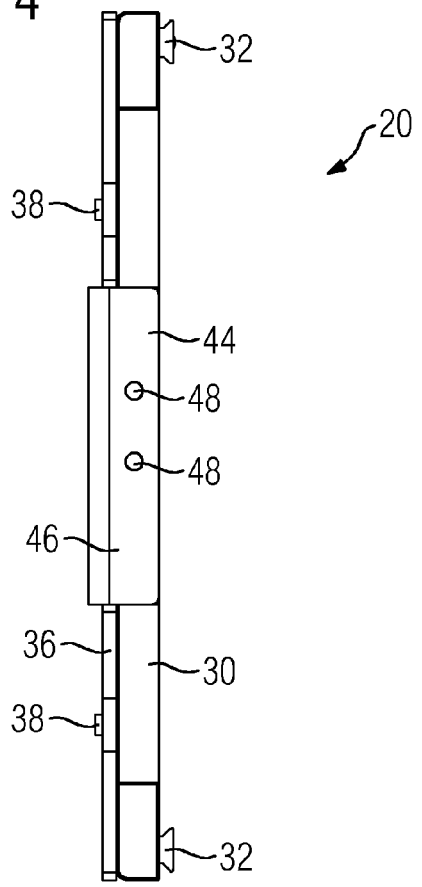
FIG. 4 shows the mounting plate in a top view
Figure 5:
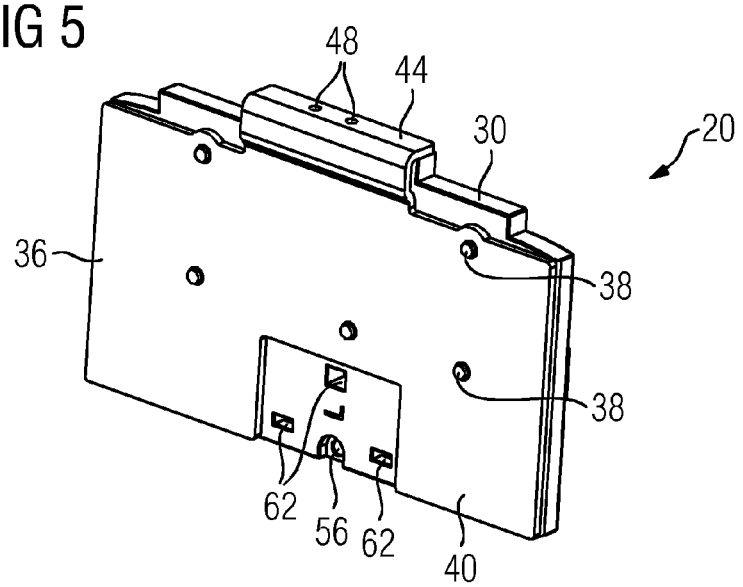
FIG. 5 shows the mounting plate in a view obliquely from the front.

FIG. 3 shows this mounting plate 20 in an oblique view from the rear, FIG. 4 shows this mounting plate in a view from above and FIG. 5 shows this mounting plate in a view oblique from the front. The mounting plate 20 has a first part 30, which consists of plastic. This plastic represents an insulation material, in the example embodiment this is a polyamide. The plate-shaped first part 30 has two holding devices 32 on one side. These holding devices 32 are used to hold the mounting plate on the wall 5 of the housing of the circuit breaker 1. In other words, the holding devices 32 are connection devices for the mechanical connection of the mounting plate with the wall of the housing of the circuit breaker.

In an embodiment, the holding devices 32 are embodied as a projection 32, which is used to engage in the recess 7 of the wall 5 of the housing of the circuit breaker 1. The projection is embodied as a dovetail-shaped projection 32. By engaging or introducing the dovetail-shaped projection 32 into the recess 7, a dovetail connection is produced. The mounting plate 20 is as a result held on the wall 5 of the circuit breaker in a form-fit manner.

Furthermore, the mounting plate 20 has a second part 36, which consists of metal. In the example embodiment, the second part 36 consists of steel. The first part 30 is fixedly connected to the second part 36. In the example embodiment, the first part 30 and the second part 36 are riveted with one another by way of riveting 38. The second part 36 represents a fitting which is attached to the first part 30. The second part 36 has a plate-shaped region 40. This plate-shaped region 40 is fixedly connected to the first part 30 in the example embodiment (here: riveted). The plate-shaped region 40 blends into a contact surface 44 of a fastening device 46. The contact surface 44 is arranged at right angles to the plate-shaped region 40. This is achieved in that the material of the second part is angled by forming the contact surface 44. In other words, the contact surface 44 is arranged perpendicularly to the plane of the mounting plate (plate plane). As shown in FIG. 2, the contact surface 44 of the mounting plate held or mounted on the circuit breaker 1 extends above the upper housing edge 8 of the housing of the circuit breaker 1.

The contact surface 44 of the fastening device 46 is used to support the circuit breaker accessory part. The contact surface 44 has two bore holes 48. The circuit breaker accessory part is fastened to the contact surface by way of these bore holes. The two bore holes have a thread in the form of an inner thread in the exemplary embodiment. The circuit breaker accessory part can be screwed to the fastening device 46 by way of this inner thread. As a result, the circuit breaker accessory part is fastened to the mounting plate 20.

FIG. 3 clearly shows that the first part 30 has reinforcing elements 52 in the form of reinforcing ribs 52. These reinforcing elements 52 ensure a high rigidity of the first part 30, as a result of which adequate distortion rigidity of the mounting plate 20 is achieved. Alternatively or in addition to the reinforcing elements 52, other reinforcing elements can however also be used, for instance metallic reinforcing insertion parts cast inside the first part.

Furthermore, the mounting plate 20 comprises a break-through 56 in the form of a through hole. This break-through 56 allows the mounting plate 20 to be additionally screwed to the wall 5 of the circuit breaker 1 by way of a screw. In order to protect this screw against unauthorized release, access to the break-through 56 by way of a securing plate 60 (cf. FIG. 2) is closed. This securing plate 60 is engaged in openings (not shown further) in the side wall 5 of the circuit breaker by way of lugs through further break-throughs 62.

The mounting plate 20 is embodied in two parts in the example embodiment. The first part 30 of the mounting plate 20 has the holding device 32, the second part 36 has the fastening device 46. The holding device 32 and/or the first part 30 consist of insulation material. The fastening device 46 and/or the second part 36 consist of metal.

Figure 6:
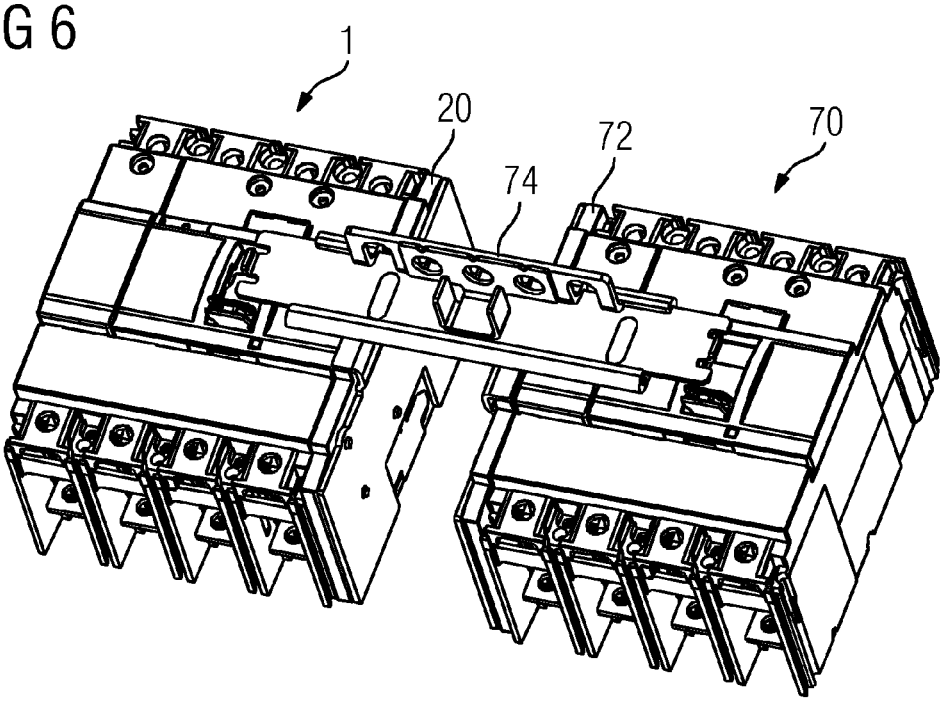
FIG. 6 shows two circuit breakers with a circuit breaker accessory part supported on two mounting plates in an oblique view and FIG. 7 shows the arrangement according to FIG. 6 in a top view.

FIG. 6 shows the circuit breaker 1 and a further circuit breaker 70. The circuit breaker 1 and the further circuit breaker 70 are structured identically. The mounting plate 20 is fastened to the first circuit breaker 1, to which further circuit breaker 70 a further mounting plate 72 is fastened. The further mounting plate 72 is structured identically to the mounting plate 20. FIG. 6 clearly indicates that the mounting plate can be arranged on both sides of the circuit breaker. The mounting plate 20 is arranged on a side of the circuit breaker, during which the further mounting plate 72 is arranged on the other (opposite) side of the circuit breaker.

The mounting plate 20 fastened to the circuit breaker 1 supports a toggle lever interlock 74. This toggle lever interlock 74 is screwed to the bore holes 48 of the mounting plate 20 by means of screws (not shown). The toggle lever interlock 74 represents a circuit breaker accessory part. By way of the toggle lever interlock, the toggle 9 of the circuit breaker 1 is locked in the position shown, i.e. the toggle lever interlock 74 prevents the toggle from moving out of the position shown.

The further mounting plate 72 of the further circuit breaker 70 likewise supports the toggle lever interlock 74. The toggle lever interlock 74 is also screwed to the further mounting plate 72 by way of screws (not shown).

Figure 7:
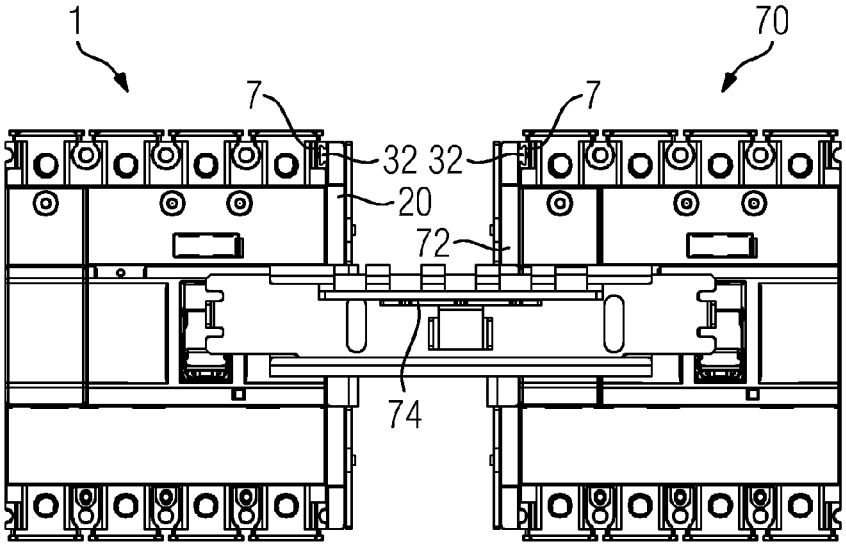

FIG. 7 shows the two circuit breakers 1 and 70 in FIG. 6 in a top view. It is particularly clear here how the dovetail-shaped holding device 32 of the mounting plate 20 engage in the recess 7 of the circuit breaker 1. It should be noted at this point that the toggle lever interlock 74 with shut-off option only represents an example of a circuit breaker accessory part. Other circuit breaker accessory parts can naturally also be fastened to the circuit breaker by means of the mounting plate 20, for instance a Bowden cable interlock, toggle lever blocking apparatus, a manual rotary drive, a motor drive or suchlike. It is naturally also possible to fasten an accessory part to just one circuit breaker by way of just one mounting plate.

A mounting plate was described, with which various circuit breaker component parts, also referred to as accessory components, can be mounted externally on a circuit breaker. It is particularly advantageous here that no fastening device for the circuit breaker accessory parts need to be provided on the circuit breaker itself. As a result, space is saved on the housing of the circuit breaker, as a result of which the circuit breaker can be embodied in a compact manner and with a small structural volume.

The mounting plate can be fastened to both sides of the circuit breaker. As a result, the number of possible fastening locations on the circuit breaker is increased and the number of different variants when fastening the circuit breaker accessory parts is increased.

The fastening devices do not need to be provided directly on the circuit breaker, so that no restrictions on the structure of the circuit breaker result. By preventing such restrictions of a geometric nature, further optional possibilities result for the design of the circuit breaker. Furthermore, the appearance of the circuit breaker is significantly smoother on account of lack of fastening devices (such as the absence of fastening bore holes etc.). This contributes to favorable customer reaction.

The use of an embodiment of the inventive mounting plate for supporting a circuit breaker accessory part produces a series of advantages: The options for using other system components are increased by space savings on account of the absence of fastening points on the circuit breaker. The mounting plate allows for e.g. the universal assembly of usual system components to be mounted on the front of the circuit breaker, such as for instance toggle lever interlocks, Bowden cable interlocks, toggle lever blocking apparatuses, manual rotary drives or motor drives. The fastening of such circuit breaker accessory parts in the immediate environment of the circuit breaker (e.g. the assembly of external accessory components on a base plate, on which the circuit breakers are mounted) is not necessary. The assembly of the circuit breaker accessory parts is thus significantly simplified.

A mounting plate for supporting a circuit breaker accessory part was described, which can be mounted on two opposing side walls of the circuit breaker. Circuit breaker accessory parts can be easily and reliably mounted on the circuit breaker by means of this mounting plate. Space for the fastening means of the circuit breaker accessory parts is advantageously saved on the circuit breaker itself.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Although the invention has been illustrated and described in detail on the basis of the preferred example embodiment, the invention is not limited by the disclosed examples and other variations can be derived herefrom by the person skilled in the art, without departing from the scope of protection of the invention.

What is claimed is:

1. A mounting plate for supporting a circuit breaker accessory part, the mounting plate comprising:

a first plate-shaped layer of a first material;

a second plate-shaped layer of a second material, the second plate-shaped layer being in direct contact with the first plate-shaped layer, the first and second plate-shaped layers being coplanar;

a holding device on the first plate-shaped layer and configured to hold the mounting plate on a wall of a housing of a circuit breaker; and a fastening device on the second plate-shaped layer and configured to fasten the circuit breaker accessory part to the mounting plate.

2. The mounting plate of claim 1, wherein the holding device is configured to embody a form-fit with the wall of the housing of the circuit breaker.

3. The mounting plate of claim 2, wherein the holding device includes a projection for engaging in a recess of the wall of the housing of the circuit breaker.

4. The mounting plate of claim 3, wherein the projection is a dovetail-shaped projection.

5. The mounting plate of claim 2, wherein the fastening device includes a contact surface for supporting the circuit breaker accessory part.

6. A circuit breaker comprising the mounting plate of claim 5.

7. A circuit breaker comprising the mounting plate of claim 2.

8. The mounting plate of claim 1, wherein the holding device includes a projection for engaging in a recess of the wall of the housing of the circuit breaker.

9. The mounting plate of claim 8, wherein the projection is a dovetail-shaped projection.

10. The mounting plate of claim 8, wherein the fastening device includes a contact surface for supporting the circuit breaker accessory part.

11. A circuit breaker comprising the mounting plate of claim 8.

12. The mounting plate of claim 1, wherein the fastening device is a bent portion of the second plate-shaped layer and overlaps an edge of the first plate-shaped layer, the fastening device having a contact surface for supporting the circuit breaker accessory part.

13. The mounting plate of claim 12, wherein the contact surface comprises at least one bore hole for fastening the circuit breaker accessory part to the contact surface.

14. The mounting plate of claim 13, wherein the at least one bore hole includes an inner thread for screwing the circuit breaker accessory part to the fastening device.

15. The mounting plate of claim 12, wherein the contact surface is arranged perpendicularly to the first and second plate-shaped layers.

16. The mounting plate of claim 12, wherein the contact surface is arranged perpendicularly to a plane of the mounting plate.

17. The mounting plate of claim 1, wherein the mounting plate includes reinforcing elements.

18. The mounting plate of claim 1, wherein the mounting plate includes a break-through for screwing the mounting plate to the wall of the housing of the circuit breaker.

19. The mounting plate of claim 1, wherein at least one of the holding device and the first plate-shaped layer include an insulation material.

20. The mounting plate of claim 19, wherein at least one of the holding device and the first plate-shaped layer include polyamide as the insulation material.

21. The mounting plate of claim 19, wherein at least one of the fastening device and the second plate-shaped layer include of a metal.

22. The mounting plate of claim 21, wherein the first plate-shaped layer is fixedly connected to the second plate-shaped layer.

23. The mounting plate of claim 19, wherein the first plate-shaped layer is fixedly connected to the second plate-shaped layer.

24. The mounting plate of claim 1, wherein at least one of the fastening device and the second plate-shaped layer include a metal.

25. The mounting plate of claim 24, wherein the metal is steel.

26. The mounting plate of claim 1, wherein the second plate-shaped layer is a fitting attached to the first plate-shaped layer.

27. A circuit breaker comprising the mounting plate of claim 1.

28. The circuit breaker of claim 27, wherein the circuit breaker is a compact circuit breaker with a housing made of insulation material.

* * * * *